United States Patent [19]

Lee

[11] Patent Number: 4,825,205

[45] Date of Patent: Apr. 25, 1989

[54] CHANGEABLE DISPLAY UNIT FOR USE IN A SIGN DEVICE

[76] Inventor: Gyu S. Lee, 239-5, Joongkok-Dong, Sungdong-Ku, Seoul, Rep. of Korea

[21] Appl. No.: 64,010

[22] Filed: Jun. 19, 1987

[30] Foreign Application Priority Data

Nov. 29, 1986 [KR] Rep. of Korea ..... 86-18874

[51] Int. Cl.[4] ..... G09G 3/34

[52] U.S. Cl. ..... 340/815.05; 340/763; 340/783; 340/815.1; 40/449

[58] Field of Search ..... 340/815.01, 815.05, 340/815.08, 815.03, 815.04, 815.10, 815.14, 815.24, 815.26, 815.25, 815.27, 815.28, 763, 764, 783; 40/463, 449, 429, 430, 466, 484

[56] References Cited

U.S. PATENT DOCUMENTS

| | | | |
|---|---|---|---|
| 3,648,281 | 3/1972 | Dahms et al. | 340/815.27 |
| 4,000,476 | 2/1977 | Romney | 40/449 |
| 4,128,825 | 12/1978 | Madsen | 340/815.24 |
| 4,176,345 | 11/1979 | Micheron et al. | 340/815.24 |

FOREIGN PATENT DOCUMENTS

| | | | |
|---|---|---|---|
| WO87/02167 | 4/1987 | PCT Int'l Appl. | 340/764 |
| 2074771 | 4/1980 | United Kingdom | 340/815.24 |

*Primary Examiner*—John W. Caldwell, Sr.
*Assistant Examiner*—Jeffery A. Brier
*Attorney, Agent, or Firm*—Birch, Stewart, Kolasch & Birch

[57] ABSTRACT

A changeable display unit for use in a sign device which comprises a case containing an electromagnet disposed therein and extending along the opposite sides thereof, the case including a case aperture disposed at the front side thereof, a fixed plate containing a plate aperture disposed at the center thereof, the fixed plate being bent at its center to form wing portions which extend therefrom, the fixed plate being attached to the case so that their respective apertures coincide, a movable plate rotably attached to the fixed plate at the center thereof, the movable plate containing a circular permanent magnet disposed therewithin whereby when the electromagnet is activated, the movable plate is selectively moved between the wing portions of the fixed plate whereby the opposite sides of the movable plate containing desired images are selectively displayed.

2 Claims, 3 Drawing Sheets

CHANGEABLE DISPLAY UNIT FOR USE IN A SIGN DEVICE

BACKGROUND OF THE INVENTION

The present invention relates to a changeable display unit for use in a sign device and more particularly, to a changeable display unit utilizing an electromagnet and a permanent magnet for selectively displaying desired images.

In many of the sign devices utilizing magnets known in the art, such as half-rotatable cylinder type sign devices or disc-type sign devices, such sign devices have to rotate 180° so that the sign devices cannot display immediately desired images under the activation thereof. And there are spaces between a plurality of display units so that the marked images are not clear.

OBJECTS AND SUMMARY OF THE INVENTION

Accordingly, it is an object of the present invention to provide an improved changeable display unit for use in a sign device.

Another object of the present invention is to provide an improved changeable display unit utilizing magnets for use in a sign device which selectively display desired images in a short period of time.

A further object of the present invention is to provide an improved sign board which shows the marked sign clearly since the plurality of display units have a square configuration and there are no spaces between each other.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to changeable display unit for use in a sign device which comprises a case containing an electromagnet disposed therein and extending along the opposite sides thereof, the case including a case aperture disposed at the front side thereof, a fixed plate containing a plate aperture disposed at the center thereof, the fixed plate being bent at its center to form wing portions which extend therefrom, the fixed plate being attached to the case so that their respective apertures coincide, a movable plate rotably attached to the fixed plate at the center thereof, the movable plate containing a circular permanent magnet disposed therewithin whereby when the electromagnet is activated, the movable plate is selectively moved between the wing portions of the fixed plate whereby the opposite sides of the movable plate containing desired images are selectively displayed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
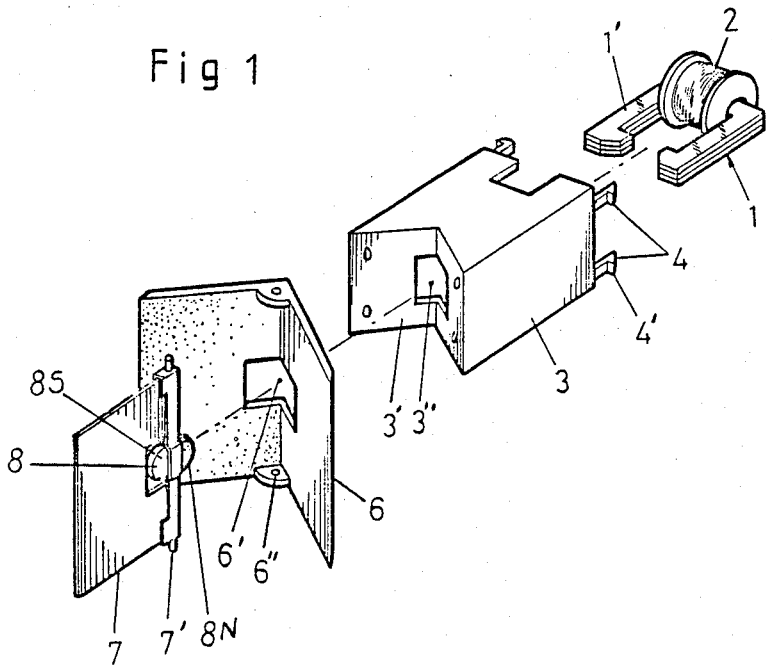
FIG. 1 is an exploded and perspective view of the changeable display unit for use in a sign device of the present invention.
Figure 2:
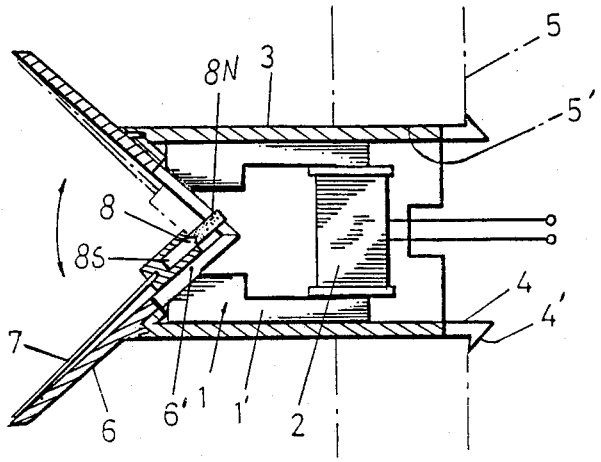
FIG. 2 is a sectional view of the changeable display unit of the present invention.
Figure 3A:
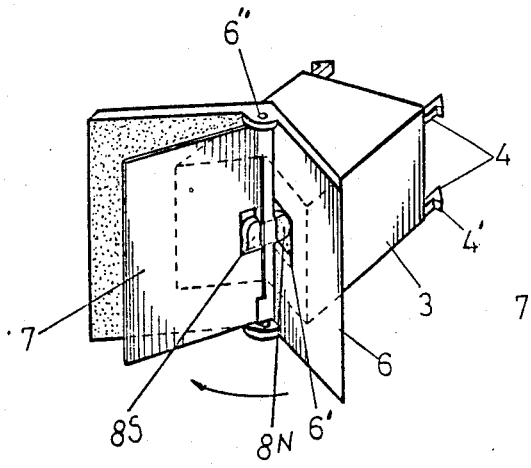
FIG. 3A is a perspective view of the changeable display unit showing the movable plate selectively moved between a wing portions of a fixed plate to show a white color.
Figure 3B:
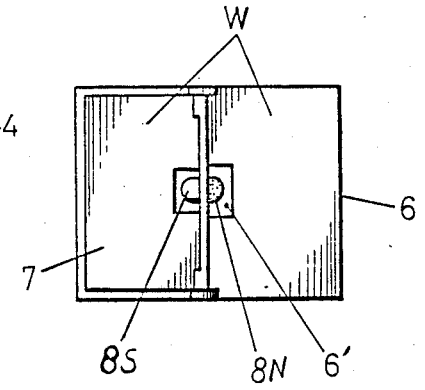
FIG. 3B is a front side elevational view of FIG. 3A.
Figure 4A:
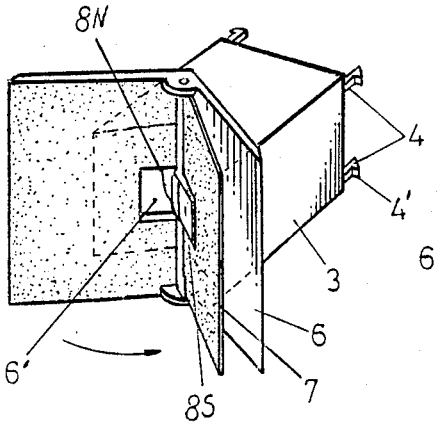
FIG. 4A is a perspective view of the changeable display unit, showing the movable plate selectively moved between the wing portions of the fixed plate to show a black color.
Figure 4B:
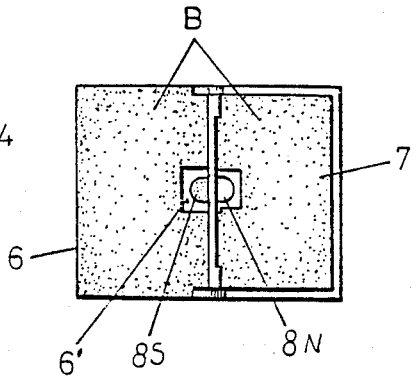
FIG. 4B is a front elevational view of FIG. 4A.

Referring now in detail to the drawings for the purpose of illustrating the present invention, the changeable display unit for use in a sign device as showing FIGS. 1 and 2 comprises a case 3 containing an electromagnet disposed therein and extending along the opposite sides thereof, and a case aperture 3″ disposed at a V-shaped front side 3′ thereof, a fixed plate 6 containing a plate aperture 6′ disposed at the center thereof, and a movable plate 7 containing a circular permanent magnet 8 disposed therewithin. The fixed plate 6 is bent at its center to form wing portions which extend therefrom. The fixed plate 6 is attached to the case 3 and the movable plate 7 attached to the fixed plate 6 so that their respective apertures coincide.

The electromagnet 1 composes of a horseshoe magnetic steel 1′ and a magnetic coil 2 wound around the magnetic steel 1′. The case 3 includes a plurality of biased members 4 having a hook member 4′ disposed at one end thereof for attaching the rear side of to case 3 a plurality of holes 5′ disposed on a base board 5. The bending angle of the fixed plate 6 is less than 90° so that the movable plate 7 can operate with a short period of response time. That is, the sign device of the present invention can immediately display the desired images. The fixed plate 6 contains engaging apertures 6″ disposed at the center edges thereof for slidably engaging ends of an axial member 7′. The circular permanent magnet 8 divides a north magnetic pole portion 8N and south magnetic pole portion 8S disposed thereon. When the fixed and movable plates 6 and 7 attaches to the V-shaped front side 3′ of the case 3, the circular permanent magnet 8 is inserted into the plate aperture 6′ disposed at the fixed plate 6 and the case aperture 3″ disposed at the V-shaped front side 3′ of the case 3. Also, the horseshoe electromagnet 1 is located around the permanent magnet 8. Thus, the permanent magnet 8 are closely positioned within the both ends of the horseshoe electromagnet 1 for easily their mutual operations. .Therefore, upon the magnetic variation of the electromagnet 1, the permanent magnet 8 is selectively moved between the wing portions of the fixed plate 6 causing the movable plate 7 to selectively move between the wing portions of the fixed plate 6 in the direction indicated by arrow (FIG. 2).

In operation, as shown in FIGS. 3A, 3B, 4A and 4B, first of all, the different colors, for example, black color B and white color W are provided on the surface of the right and left sides of the fixed plate 6, respectively.

Also, the different colors, for example, the black color B and the white color W are provided on both sides e.g., the inside and outside of the movable plate 7. However, when the movable plate 7 attaches to the fixed plate 6, the same color e.g., black color or white color of the fixed plate 6 and movable plate 7 is to be arranged.

When the magnetic coil is activated, the electromagnet 1 is magnetized and immediately, the movable plate 7 is moved to the right side between the wing portions of the fixed plate 6 by attraction and repelling of the electromagnetic poles and permanent magnetic poles. Therefore, the fixed plate 6 shows white color. After then, on the contrary, the magnetic coil is activated, the electromagnet 1 is magnetized and immediately, the movable plate 7 is, vice versa, moved to left side between the wing portions of the fixed plate 6. Therefore, the fixed plate 6 changes from the white color shown in FIG. 3B to black color shown in FIG. 4B.

Figure 5:
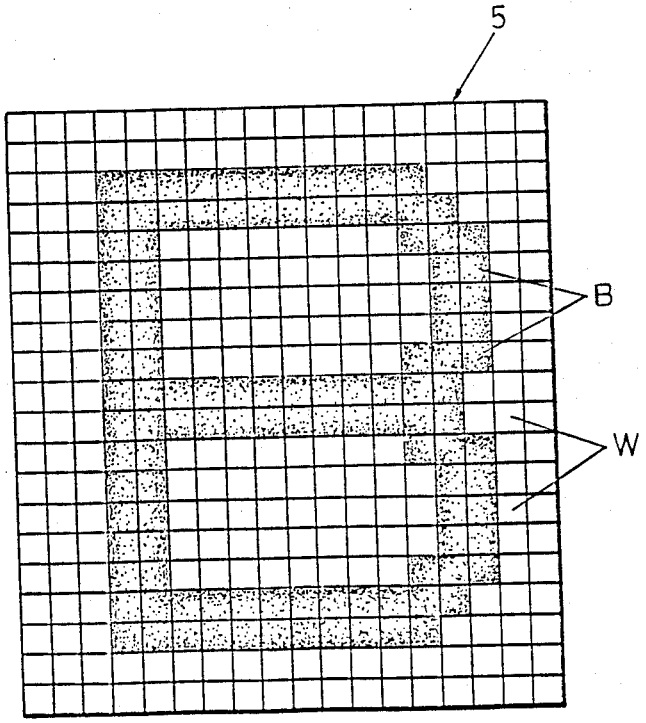
FIG. 5 is a front elevational view of a letter B displayed by the sign board of the present invention.

Accordingly, the plurality of display units of the present invention, of which the rear side is inserted to the base board 5 to show a desired image such as "B" letter as shown in FIG. 5.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An interchangeable display unit for use in a sign device which comprises:

a case containing an electromagnet disposed therein and extending along opposite sides thereof, said case including a case aperture disposed at a front side thereof and a plurality of biased members disposed at a rear side of said case for mounting to a baseboard, a fixed plate containing a plate aperture disposed at the center thereof, said fixed plate being bent with a bending angle of less than 90° at is center to form wing portions which extend therefrom, said fixed plate being attached to said case so that their respective apertures coincide, and a movable plate rotably attached to said fixed plate at the center thereof, said movable plate having various colors on its surfaces which are different from or the same as the color on the surfaces of said wing portions, respectively, and a circular permanent magnet which faces said electromagnet through said apertures whereby after each display unit is inserted into the baseboard by the plurality of biased members, when the electromagnet is activated, the movable plate is selectively moved between the wing portions of the fixed plate in a short response time whereby the colors on the opposite side surfaces on the movable plate and the fixed plate are selectively combined with each other on the baseboard to create a desired sign.

2. The changeable display unit device of claim 1 wherein the front side of the case corresponds in dimension to the dimension of the fixed plate.

* * * * *